US007318528B1

(12) United States Patent
Hessabi

(10) Patent No.: US 7,318,528 B1
(45) Date of Patent: Jan. 15, 2008

(54) PRECIOUS METAL RECOVERY

(76) Inventor: Iradj Hessabi, 12017 Oakland Hills Dr., Las Vegas, NV (US) 89141

( * ) Notice: Subject to any disclaimer, the term of this patent is extended or adjusted under 35 U.S.C. 154(b) by 502 days.

(21) Appl. No.: 10/898,701

(22) Filed: Jul. 26, 2004

(51) Int. Cl.
*B03C 1/00* (2006.01)

(52) U.S. Cl. ..... 209/215; 209/8; 209/225

(58) Field of Classification Search ..... 209/39, 209/132, 174, 213, 232, 8, 215, 225–228; 241/24.1; 198/690.1
See application file for complete search history.

(56) References Cited

U.S. PATENT DOCUMENTS 1,611,791 A * 12/1926 Stockton ..... 241/17
2,420,392 A * 5/1947 Christensen et al. ..... 209/3
2,956,347 A * 10/1960 Gordon ..... 34/371
3,463,310 A * 8/1969 Berman et al. ..... 209/8
3,627,678 A * 12/1971 Marston et al. ..... 210/695
3,676,337 A * 7/1972 Kolm ..... 210/695
4,313,573 A * 2/1982 Goldberger et al. ..... 241/1
5,762,204 A * 6/1998 Yang et al. ..... 209/172.5
6,006,920 A * 12/1999 Bilimoria et al. ..... 209/8

* cited by examiner

*Primary Examiner*—Patrick Mackey
*Assistant Examiner*—Kalyan Kumar
(74) *Attorney, Agent, or Firm*—Veronica-Adele R. Cao; Weiss & Moy, P.C.

(57) ABSTRACT

A pulse of over six kilovolts with a duration of 200 nanoseconds causes an explosion that fragments a mineral deposit with metals embedded therein. The fragmentation separates the metals from the mineral. A conditioning electromagnet temporarily magnetizes the metals. A sorting magnet attracts one of the magnetized metals.

13 Claims, 5 Drawing Sheets

PRECIOUS METAL RECOVERY

FIELD OF INVENTION

This invention is in the field of precious metal recovery and, more particularly, causing an electrically generated explosive fragmentation that separates the metals from waste materials.

DESCRIPTION OF THE PRIOR ART

Present day extraction of precious metals from ore is done mainly with chemicals, high temperature furnaces or grinding machines. In a chemical extraction process, for example, a cyanide mixture is prepared from sodium cyanide crystals that are dissolved in a small volume of water and boiled with sodium peroxide. The cyanide mixture is usually placed in a tank with water wherein calcium oxide is added to form a solution that is alkaline. The gold ore is placed within the solution.

The recovery of the gold is accomplished by circulating the solution through charcoal filters that are then washed with hot alkalies, such as sodium hydroxide, that augment the solution. Zinc is used to reduce the gold from the augmented solution.

There is an unused waste product, called black sand, that is made up of different metals encased in silicate. Black sand cannot be refined through either the chemical, high temperature or grinding process.

From the description given hereinbefore, a conventional refining of gold ore that involves a use of caustic chemicals, is undesirably time consuming and is expensive. Additionally, there may be an undesired chemical alteration of some of the matter comprising the ore.

SUMMARY OF THE INVENTION

According to one aspect of the present invention, a mineral deposit has one or more types of metals embedded therein. While the deposit is under water, an electric pulse of over six kilovolts and a duration in a range of 200 nanoseconds to 500 nanoseconds is used to cause an explosive fragmentation of the deposit that separates the metals from minerals.

According to another aspect of the present invention, the fragmented deposit is placed within a magnetic field that causes a temporary magnetization of metals therein. During the magnetization, an attraction between one of the recovered metals and a collection electromagnet is used to separate the one recovered metal from other recovered metals.

When the invention is used to recover metals from black sand, for example, approximately two tons of the black sand per hour can be processed.

Other objects, features, and advantages of the invention should be apparent from the following description of the preferred embodiment thereof as illustrated in the accompanying drawing.

DESCRIPTION OF THE PREFERRED EMBODIMENT

Figure 1:
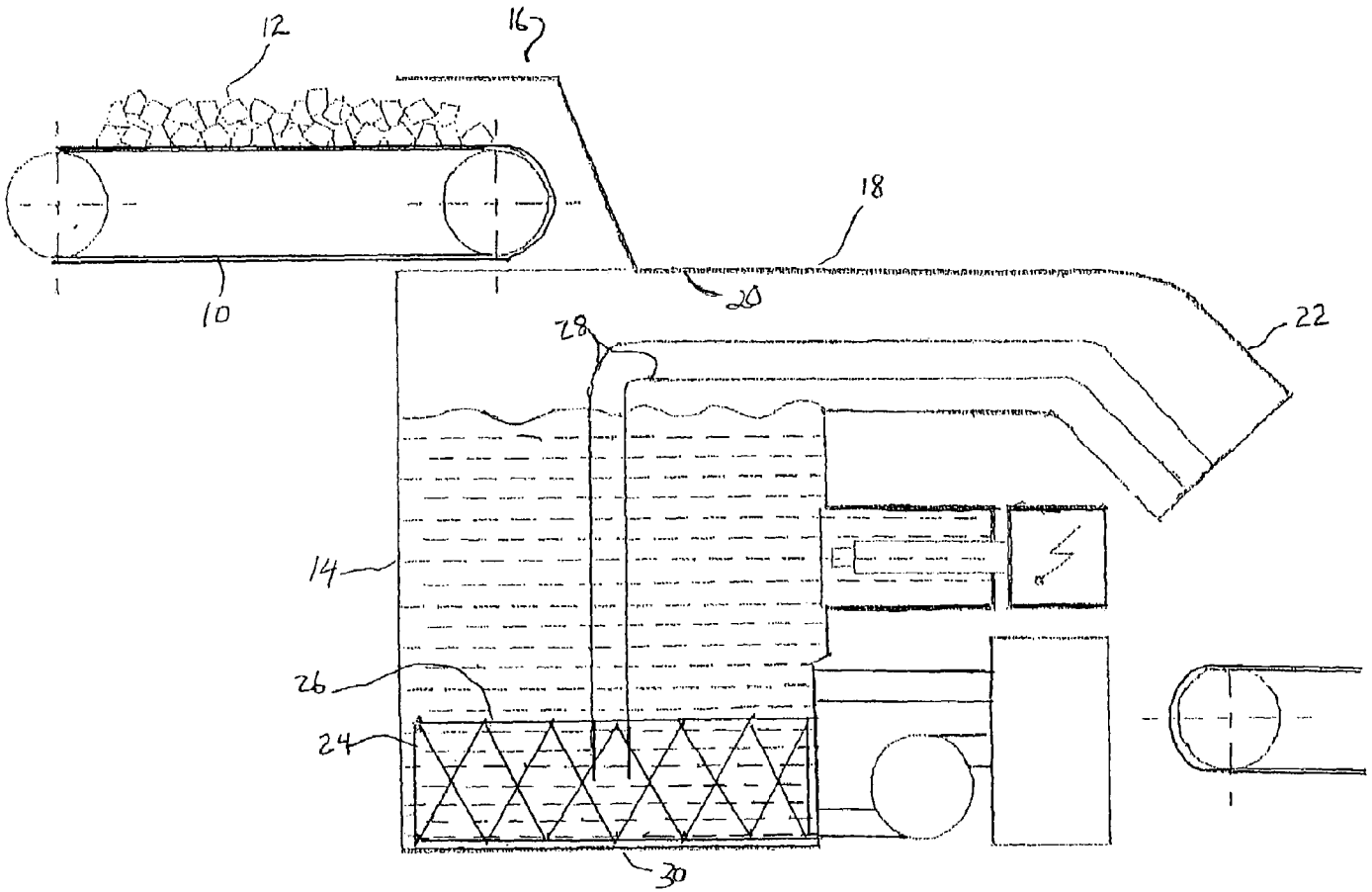
FIG. 1 is a plan view, with a portion broken away, of a tank prior to rock with that is embedded with precious metal being dumped therein.

A first object of a recovery process described herein is to separate metals from rock wherein the metals are embedded. As shown in FIG. 1, a conveyor 10 carries silicon rocks 12 with the metals embedded therein. The conveyor 10 is proximal to a water filled tank 14 at an entrance port 16 thereof. The conveyer 10 is operable to transport rocks from a storage location to the port 16.

An upper portion of the tank 14 includes a chute 18. Although the chute 18 is generally horizontal, it has an end slopes downward to provide an exit port 22 from the tank 14.

Within the tank 14 is a crib 24 of wire mesh construction. The crib 24 has an open top 26. Additionally, tracks 28 extend from a location near a bottom 30 of the tank 14, through the entrance port 20 to the exit port 22. The crib 24 is moveable along the tracks 28.

Figure 2:
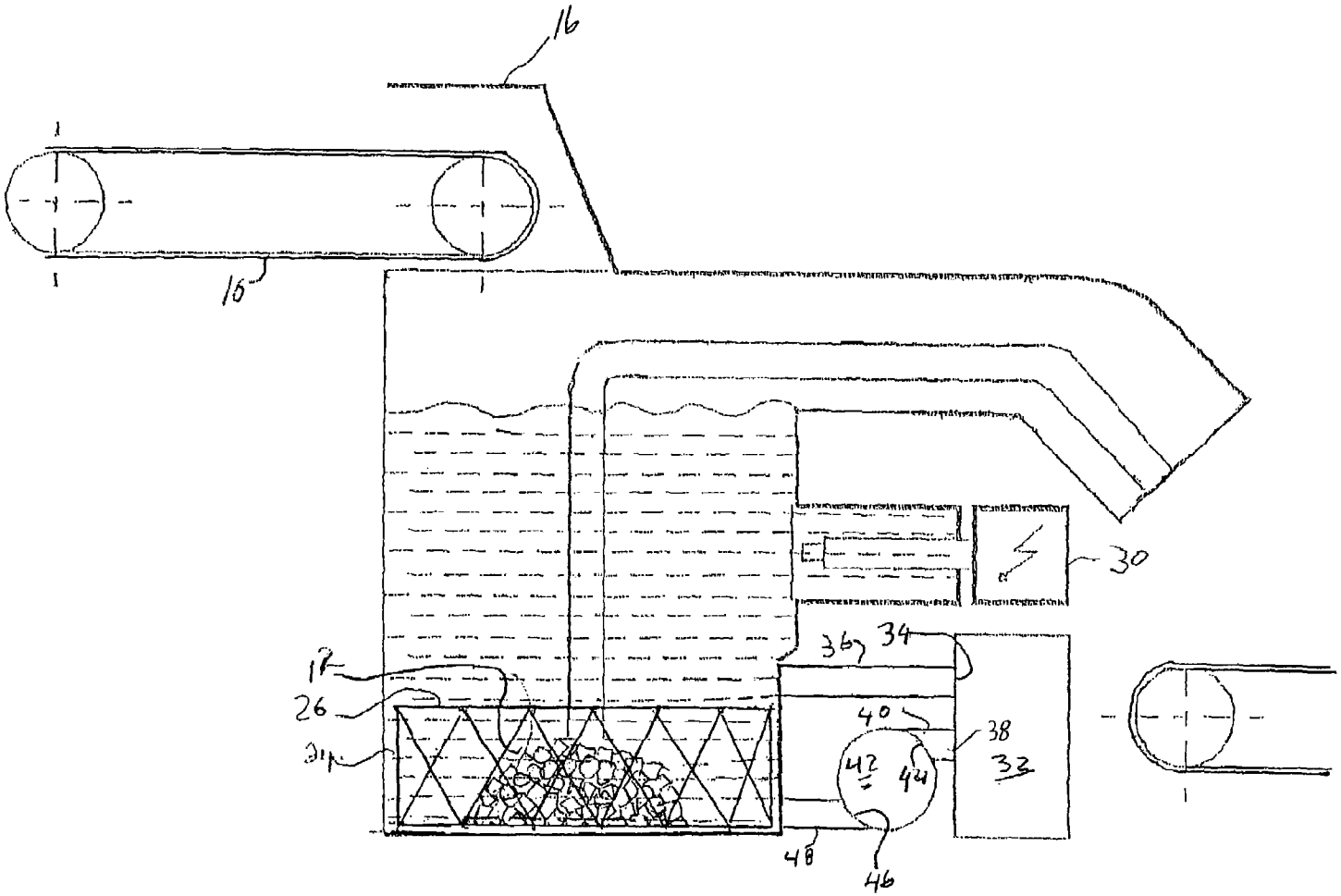
FIG. 2 is a plan view of the tank of FIG. 1 after the rock embedded with precious metal has been dumped therein.

As shown in FIG. 2. the rocks 12 are dumped from the conveyor 10 through the top 26 into the crib 24. Thereafter, a generator 30 generates a pulse of over six kilovolts with a duration of approximately 200 nanoseconds. The pulse is transmitted through the water in the tank 14 to the rocks 12 thereby causing the rocks 12 to explode and form a mixture of fragmented rocks and metals 13.

The interior of the tank 14, the crib 24 and the tracks 28 are coated with a plastic that has a high electrical resistance to prevent a transmission therethrough of the pulse.

The pulse may cause an accumulation of unwanted debris in the tank. The debris is eliminated by operation of a filtration system that includes a filter 32 that has an inlet 34 connected to the interior of the tank 14 through a pipe 36. Hence, water from the tank 14 passes into the filter 32.

An outlet port 38 of the filter 32 is connected through a pipe 40 to a pump 42 at an inlet 44 thereof. An outlet 46 of the pump 42 is connected through a pipe 48 to the tank 14. In other words, water taken from the tank 14 is filtered and pumped back the tank 14.

Figure 3:
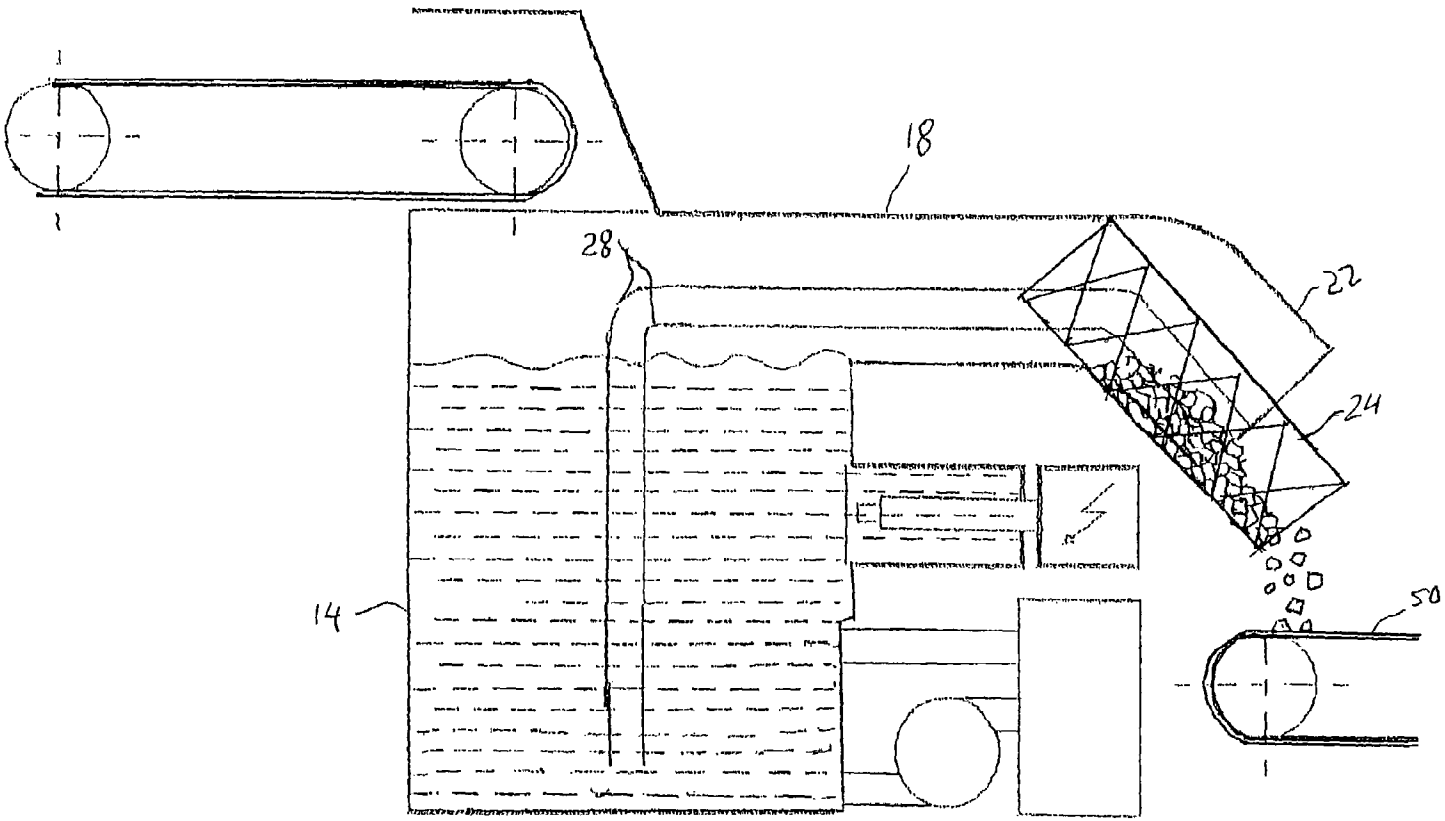
FIG. 3 is a plan view of the tank of FIG. 1 where an explosion has formed a mixture of fragmented rocks and metal that is loaded onto a drying and dust removal conveyor.

A second object of the recovery process is to separate different metals of the fragmented mixture 13 from each other and from non-metallic debris. As shown in FIG. 3, the crib 24 is moved along the tracks 28 to the port 22 where the fragmented mixture 13 is deposited upon a drying and dust removal conveyor belt 50.

Figure 4:
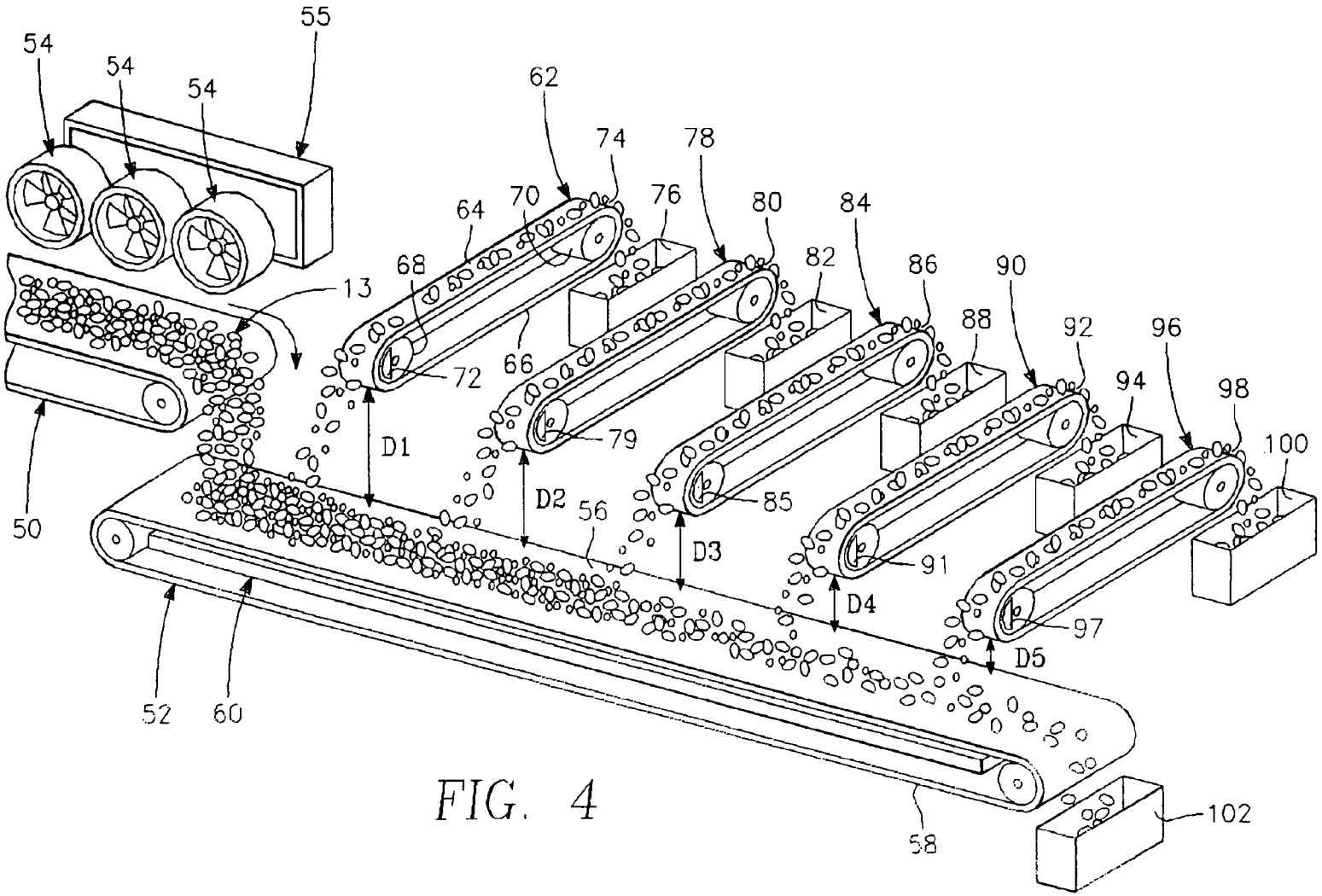
FIG. 4 is a perspective view of the mixture of FIG. 3 being conveyed from the drying and dust removal conveyor to a sorting conveyer.

As shown in FIG. 4, the belt 50 conveys the fragmented mixture 13 onto a sorting belt 52. A plurality of fans 54 are proximal to a path of conveyance of the belt 50. The fans 54 blow warm air from a heater 55 thereby blowing away unwanted dust and debris and drying the fragmented mixture 13.

The belt 52 has a carrying part 56 and a return part 58. The mixture 13 is carried on the carrying part 56. A conditioning electromagnet 60 is positioned between the parts 56, 58. Excitation wires of the conditioning electromagnet 60 are not shown. A separation conveyor belt 62 is positioned in a plane that is parallel to the planes of the parts 56, 58.

The belt 62 has a carrying part 64 and a return part 66 that are driven by wheels 68, 70. The parts 64, 66 are driven along paths that are perpendicular to the paths of the parts 56, 58. An collection electromagnet 72 is positioned within the wheel 68. Excitation wires of the collection electromagnet 72 are not shown.

Figure 5:
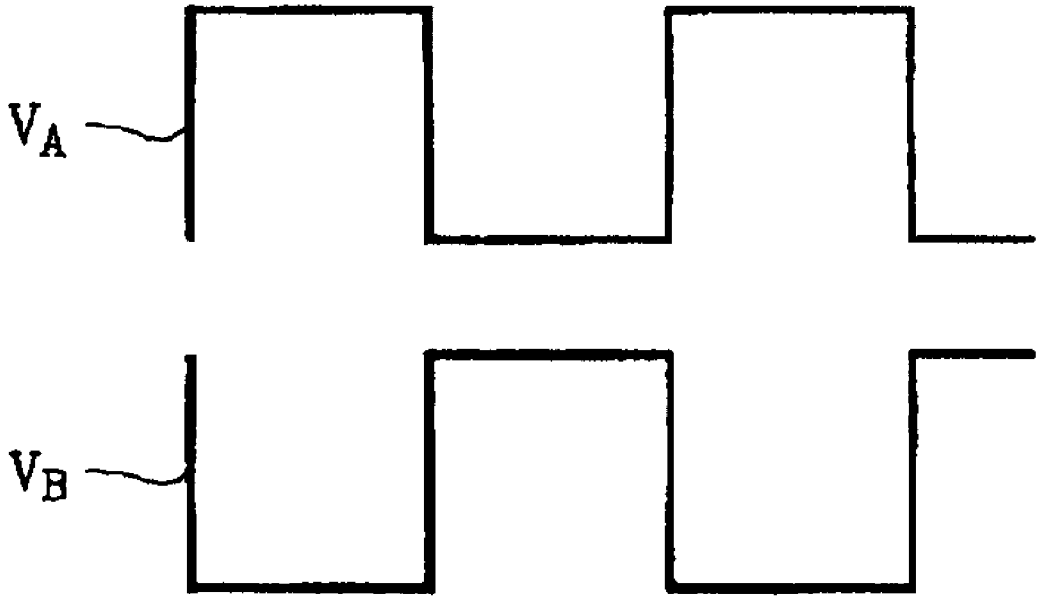
FIG. 5 is a waveform of excitation applied to an electromagnet of the separation conveyor of FIG. 4 and a waveform of excitation applied to a conditioning electromagnet.

As shown in FIG. 5, a voltage, $V_A$, that is applied to the excitation wires of the collection electromagnet 72 is comprised of pulses of ½ second duration with ½ second therebetween. A voltage, $V_B$, that is applied to the excitation wires of the conditioning electromagnet 60, shown on the same time scale as the voltage, $V_A$, is comprised of pulses similar to those of the voltage, $V_A$. However, when the voltage, $V_A$, has its zero value, the voltage, $V_B$, has its non-zero value and vice versa.

It should be understood that all metals are magnetized when placed in a magnetic field. When the field is removed, a metal such as gold, for example, retains its magnetism for a time on the order of one second. Additionally, the strength of the magnetism retained by each metal is different. As explained hereinafter, this difference makes possible a reliable apparatus and process for separating metals of the fragmented mixture 13 from each other.

After metals of the fragmented mixture 13 have been magnetized by the conditioning magnet 60, they are attracted to the belt 62 by the collection magnet 72. However, the strength of the attraction of the collection magnet 72 is inversely related to a vertical distance, D1, between the belt 62 and the fragmented mixture 13.

Iron acquires a first level of magnetization from the conditioning electromagnet 60. The distance, D1, is selected to cause magnetism provided by the collection magnet 72 to be sufficient to move iron to the belt 62 but insufficient to move metals that acquire less than the first level of magnetization. Aluminum, gold, silver and platinum are examples of metals that acquire less than the first level of magnetization.

In other words, only iron is attracted to the belt 62. Beneath an end 74 of the belt 62 is a collection tray 76. Iron from the belt 62 falls into the tray 76.

Aluminum acquires a second level of magnetization from the conditioning electromagnet 60. Adjacent to the belt 62 is a conveyor belt 78 that is similar to the belt 62. There is a vertical distance, D2, between the belt 78 and the part 56.

The belt 78 has a collection electromagnet 79 that is similar to the collection electromagnet 72. The distance, D2, is less that the distance, D1. The distance, D2, is selected to cause magnetism provided by the collection electromagnet 79 to be sufficient to move aluminum to the belt 78 but insufficient to move metals that acquire less than the second level of magnetization. Gold, silver and platinum are examples of metals that acquire less than the second level of magnetization.

In other words, only aluminum is attracted to the belt 78. Beneath an end 80 of the belt 78 is a collection tray 82. Aluminum from the belt 78 falls into the tray 82.

Gold acquires a third level of magnetization from the conditioning electromagnet 60. Adjacent to the belt 78 is a conveyor belt 84 that is similar to the belt 62. There is a vertical distance, D3, between the belt 84 and the part 56.

The belt 84 has a collection electromagnet 85 that is similar to the collection electromagnet 72. The distance, D3, is less that the distance, D2. The distance, D3, is selected to cause magnetism provided by the collection electromagnet 85 to be sufficient to move gold to the belt 84 but insufficient to move metals that acquire less than third level of magnetization. Silver and platinum are examples of metals that acquire less than the third level of magnetization.

In other words, only gold is attracted to the belt 84. Beneath an end 86 of the belt 84 is a collection tray 88. Gold from the belt 84 falls into the tray 88.

Silver acquires a fourth level of magnetization from the conditioning electromagnet 60. Adjacent to the belt 84 is a conveyor belt 90 that is similar to the belt 62. There is a vertical distance, D4, between the belt 84 and the part 56.

The belt 90 has a collection electromagnet 91 that is similar to the conditioning electromagnet 72. The distance, D4, is less that the distance, D3. The distance, D4, is selected to cause magnetism provided by the collection electromagnet 91 to be sufficient to move silver to the belt 84 but insufficient to move metals that acquire less than the fourth level of magnetization. Platinum is an example of a metal that acquires less than the fourth level of magnetization.

In other words, only silver is attracted to the belt 90. Beneath an end 92 of the belt 90 is a collection tray 94. Silver from the belt 90 falls into the tray 94.

Platinum acquires a fifth level of magnetization from the conditioning electromagnet 60. Adjacent to the belt 90 is a conveyor belt 96 that is similar to the belt 62. There is a vertical distance, D5, between the belt 96 and the part 56.

The belt 96 has a collection electromagnet 97 similar to the collection electromagnet 72. The distance, D5, is less that the distance, D4. The distance, D5, is selected to cause magnetism provided by the collection electromagnet 97 to be sufficient to move platinum to the belt 96 but insufficient to move metals that acquire less than the fifth level of magnetization.

In other words, only platinum is attracted to the belt 96. Beneath an end 98 of the belt 96 is a collection tray 100. Platinum from the belt 96 falls into the tray 100.

Non-metallic debris falls from the part 56 into a tray 102.

I claim:

1. In a method of recovering metals from a mineral deposit wherein the metals are embedded, the steps of:

providing a tank with water therein;

depositing the mineral deposit within the tank;

generating an electrical pulse that causes an explosive fragmentation of the under water deposit within the tank, thereby forming a fragmented rock and metal mixture;

removing the mixture from the tank;

providing an apparatus for sorting the metals comprising:

means for conveying the mixture from the tank to a sorting location;

a conditioning electromagnet at the sorting location to temporarily magnetize the metals of the mixture; and a plurality of collection electromagnets;

positioning each collection electromagnet at a known vertical distance from the mixture and positioning each subsequent collection electromagnet at a lesser vertical distance than a previous collection electromagnet;

magnetizing the metals with the conditioning electromagnet;

attracting a plurality of metals in the mixture with the plurality of collection electromagnets, each metal having a different magnetization level and being attracted to only one of the plurality of collection electromagnets; and collecting each of the plurality of metals.

2. In the method of claim 1 wherein said pulse is over six kilovolts with a duration in a range of 200 ns to 500 ns.

3. In the method of claim 1, further comprising the steps of:

providing a heater that provides warm air;

providing a plurality of fans proximal to a path of conveyance of said means for conveying the mixture from the tank to a sorting location, said plurality of fans for blowing said warm air onto said mixture while it is being conveyed;

drying and blowing away dust and debris from the mixture with warm air blown by said plurality of fans.

4. Apparatus for separating metals from a mineral deposit wherein the metals are embedded, comprising:

a tank of water wherein the mineral deposit is placed;

a generator that generates a pulse that causes an explosive fragmentation of the deposit, thereby forming a fragmented mineral and metal mixture where metals are separated from minerals;

means for conveying said mixture from the tank to a sorting location;

a conditioning electromagnet at the sorting location that temporarily magnetizes the metals of said mixture; and a plurality of collection electromagnets, each collection electromagnet being positioned at a known vertical distance from said mixture and wherein each subsequent collection electromagnet being positioned at a lesser vertical distance than a previous collection electromagnet.

5. The apparatus from claim 4 additionally comprising:

a heater that provides warm air;

one or more fans that blows the warm air onto said mixture while it is being conveyed.

6. The apparatus of claim 5 additionally comprising means for collecting metal attracted to the collection electromagnet.

7. An apparatus for separating metals from a mineral deposit wherein the metals are embedded, comprising:

a tank of water wherein the mineral deposit is placed;

a generator that generates a pulse that causes an explosive fragmentation of the deposit, thereby forming a fragmented mineral and metal mixture where metals are separated from minerals;

a conveyor belt for conveying said mixture from said tank to a sorting belt, said sorting belt having a carrying part and a return part;

a conditioning electromagnet positioned between said carrying part and said return part of said sorting belt that temporarily magnetizes said metals of said mixture;

a plurality of separation conveyor belts positioned in a plane that is parallel to the plane of said carrying part and said return part of said sorting belt; and a plurality of collection electromagnets, each collection electromagnet being coupled to one of said plurality of separation conveyor belts.

8. The apparatus of claim 7 wherein each separation conveyor belt has a carrying part and a return part that are driven along paths that are perpendicular to the paths of said carrying part and said return part of said sorting belt.

9. The apparatus of claim 8 wherein said carrying part and said return part of each said separation conveyor belt being driven by a first wheel and a second wheel.

10. The apparatus of claim 9 wherein each said collection electromagnet being coupled to one said first wheel of one of said separation conveyor belts.

11. The apparatus of claim 7 wherein each of said plurality of collection electromagnets being positioned at a known vertical distance from said mixture and wherein each subsequent collection electromagnet being positioned at a lesser vertical distance than a previous collection electromagnet.

12. The apparatus of claim 7 wherein each of said plurality of collection electromagnets attracts a different metal.

13. The apparatus of claim 7 further comprising:

a heater that provides warm air;

a plurality of fans proximal to a path of conveyance of said conveyor belt, said plurality of fans for blowing said warm air onto said mixture while it is being conveyed.

* * * * *